United States Patent [19]

Ferrari

[11] 4,343,045

[45] Aug. 10, 1982

[54] SHOULDER GARMENT

[76] Inventor: Gino Ferrari, 83 Colebay Corner, St. Maarteen, Netherlands

[21] Appl. No.: 224,066

[22] Filed: Jan. 12, 1981

[51] Int. Cl.[3] ..... A41D 23/00
[52] U.S. Cl. ..... 2/92
[58] Field of Search ..... 2/92, 88, 91, 45, 44, 2/50

[56] References Cited

U.S. PATENT DOCUMENTS

| | | | |
|---|---|---|---|
| 276,720 | 5/1883 | Seiler | 2/84 |
| 1,850,496 | 3/1932 | Chisholm | 2/92 |

*Primary Examiner*—Doris L. Troutman
*Attorney, Agent, or Firm*—Frank P. Cyr

[57] ABSTRACT

A shoulder garment adapted to be worn particularly by persons who are exposed almost overnight to strong sun rays to thus prevent a sun burn on the shoulders of the wearer. Also, the shoulder garment may be worn over a jacket or shirt so as to present an ornamental article of wearing apparel.

3 Claims, 7 Drawing Figures

SHOULDER GARMENT

BACKGROUND OF THE DISCLOSURE

Tourists, particularly those travelling from a cold climate to a warm climate suddenly find themselves, almost overnight, exposed to strong sun rays and quite frequently due to their anxiety to quickly acquire a suntan, find that they have overexposed themselves to the sun's rays and end up with a severe burn, particularly at the upper portion of the body such as the forehead, and for bald people, the sun's rays can cause a severe case of sun burn of these parts of the body unless some protective covering is employed, such as a hat or cap to shield the sun's rays. The exposure of the shoulders to the sun's rays can result in a severe case of sun burn of these parts of the body unless some protective garment is employed to shield this part of the body from the sun's rays.

Oftentimes one will employ a towel or the like to shield the shoulders from the sun's rays. However, this is not entirely satisfactory since when one using a towel as a shield removes the towel after having been exposed to the sun's rays for some time, he or she will find that a sharp line of demarcation will appear to denote that portion of the shoulders and adjacent body portions which have been shielded by the towel and that portion of the shoulders which has been exposed to the sun's rays.

This line of demarcation between that portion of the shoulders which has not been exposed to the sun's rays and that portion of the shoulders which has been exposed to the sun's rays is undesirable as it detracts from the appearance of one who has an even tan throughout most of the body.

Also, as is well known, overexposure to the sun's rays can result in skin cancer or some other undesirable effects on the skin.

With the above in mind, it is one object of the invention to provide a garment which may be placed over the shoulders of the wearer to thus provide an effective shield from the sun's rays and to prevent the wearer from acquiring a sun burn at this portion of the body.

Another object of the invention is to provide a shoulder garment with a fringe extending a short distance below the main portion of the garment to thus permit for some of the sun's rays to penetrate through some of the fringe area thus effecting a partial suntanning of the skin underlying the fringe area.

Another object of the invention is to provide a shoulder protective garment with means whereby the same may be held in proper position on the shoulders of the garment by means of straps encircling the upper portion of the body of the wearer.

Another object of the invention is to provide a shoulder worn garment provided with a fringe area extending a short distance below the body of the garment whereby the garment may be worn over a jacket of conventional construction to thereby enhance the appearance of the garment.

Other objects and advantages will become more apparent or will be pointed out in connection with the following description and the accompanying drawings which show the preferred arrangements of parts which may be employed in carrying out my invention.

DESCRIPTION OF THE PREFERRED EMBODIMENTS

Figure 1:
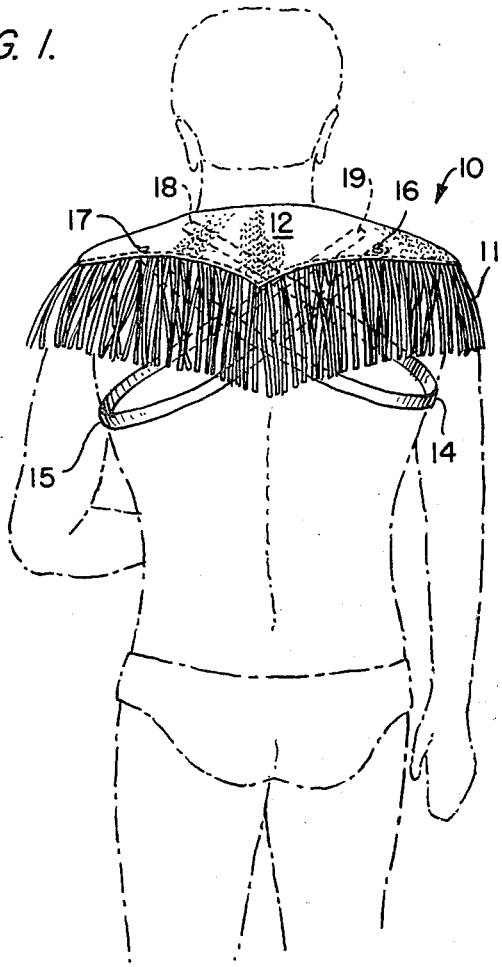
FIG. 1 is a perspective view of the shoulder garment applied over the shoulders of the wearer and showing the straps employed for securing the garment to the body of the wearer.

Referring now to the drawings wherein like reference numerals are employed to designate like parts throughout the several views, reference numeral 10 designates in general the garment of the present invention. The garment is of generally rectangular shape such as shown in the several views of the drawings and may be made of terry cloth or the like. Actually, the cloth should be one which will permit for some of the sun's rays to penetrate therethrough, although it will shield some of the sun's rays to thus permit for some tanning of the skin underlying the garment.

The garment is provided with a fringe 11 which extends a short distance below the body 12. The fringe is secured to the body 12 as by sewing, adhesive binding or the like and as can be appreciated, a fringe consists of a number of cords or threads hanging loose or tied in bunches at the top. Thus, the sun's rays will penetrate the same but at a lesser amount than if this area was covered with a cloth or the like.

Figure 2:
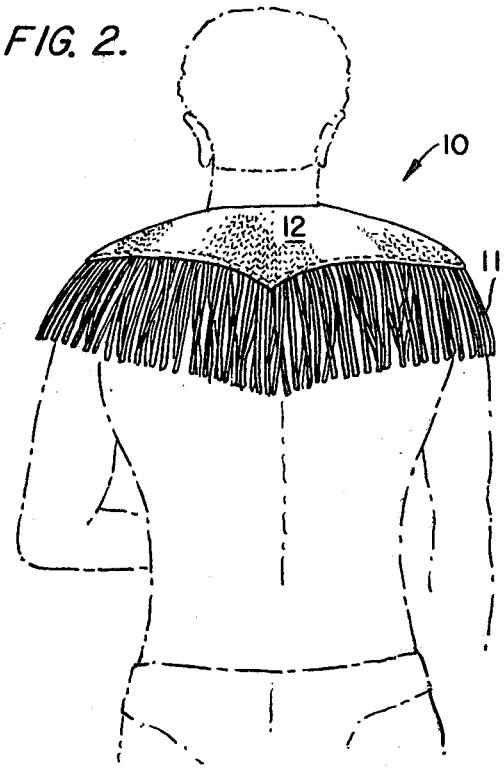
FIG. 2 is a perspective view of the garment applied to the shoulders of the wearer, minus the straps.

The garment is provided with an opening 13 so that the garment is slipped over the head of the wearer with the front, rear and side portions extending over the shoulders of the wearer such as shown in FIGS. 1 and 2 of the drawings.

Figure 4:
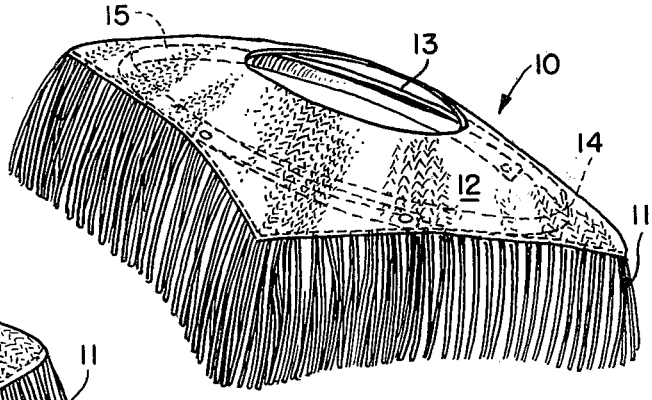
FIG. 4 is a perspective view of the shoulder garment.

The garments may be worn by the participants in sports such as volley ball, etc., which is usually played on the beach. In such instances it is necessary that the garment be securely held in proper position on the shoulders of the wearer. For this purpose, straps 14, 15 are detachably secured as at 16, 17 to the inner portion of the body 12 of the garment. As seen more particularly in FIG. 1 of the drawings, when it is desired to firmly retain the garment on the shoulders of the wearer, the straps are caused to extend under the arms of the wearer and then to the front of the garment where they will engage with suitable fastener means 18, 19 provided at the rear portion of the garment. Thus, with the garment held on the shoulders of the wearer in the manner aforesaid, there is no impairment to the use of the arms of the participant in the sports while, however, affording protection from the sun's rays. When the straps are not in use, they may be stored within the inner portion of the garment such as shown in FIG. 4 of the drawings.

Figure 3:
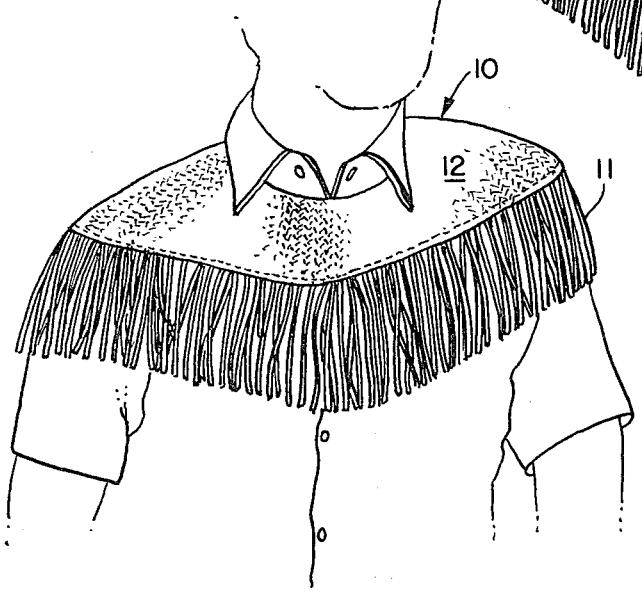
FIG. 3 is a perspective view of the shoulder garment applied over a conventional jacket.

Many body garments such as jackets and the like are presently being provided with fringe areas so as to add to the outward appearance of the jacket. Normally the fringe areas are secured to the outside of the garment as by sewing or the like and forms a permanent addition to the jacket. With the present invention, the garment may be slipped over the head of the wearer of the jacket and allowed to extend over the shoulders of the wearer of the jacket such as shown in FIG. 3 of the drawings. Thus, the garment of the present invention may not only be used as a shield from the sun's rays but may also be used to enhance the appearance of a jacket or like article of wearing apparel.

Figure 5:
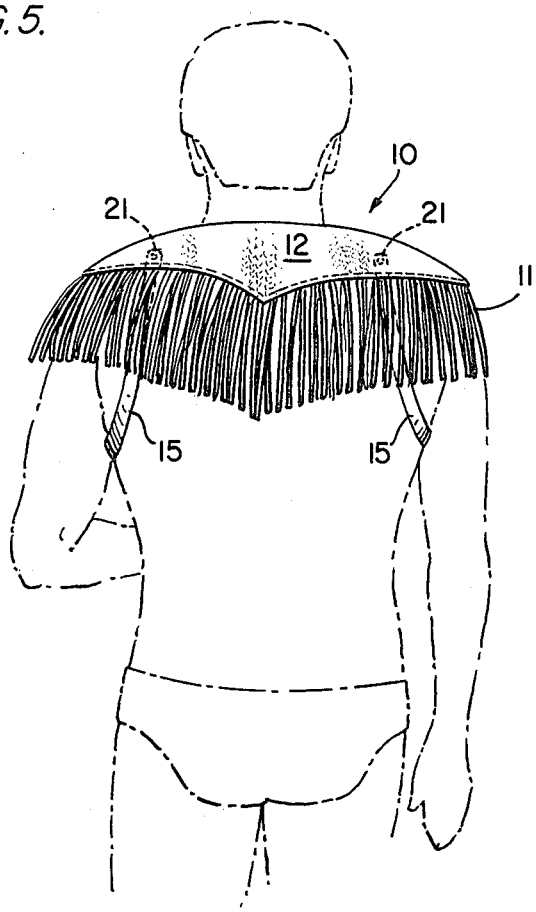
FIG. 5 is a modification of the garment of the present invention.
Figure 6:
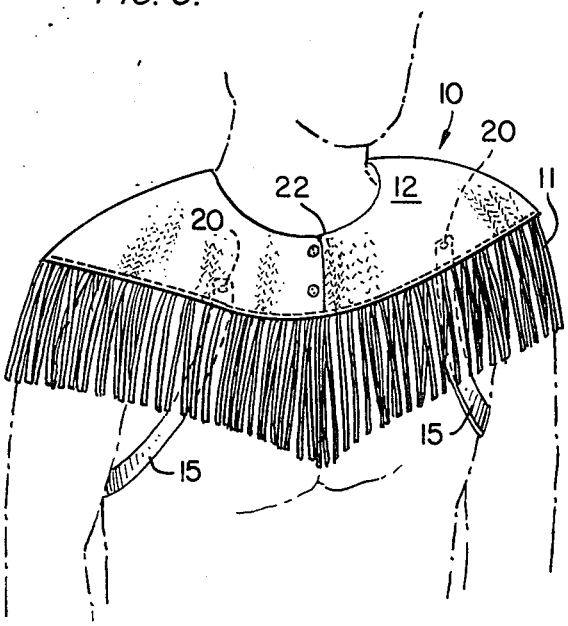
FIG. 6 is a still further modification of the garment of the present invention, and, FIG. 7 is a view similar to that shown in FIG. 6 showing the straps in storage when not in use.
Figure 7:
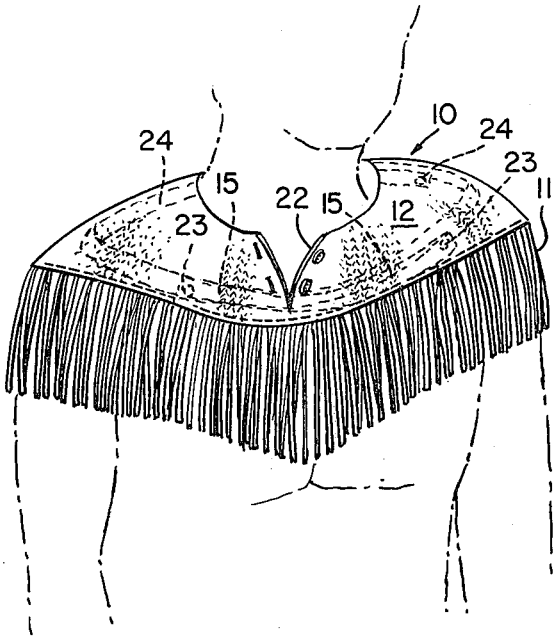

Referring now more particularly to FIGS. 5 to 7 inclusive of the drawings, a garment similar to that previously described is shown. However, in lieu of having the straps 15 criss-cross the body of the wearer in order to retain the garment in proper position on the shoulders of the wearer, the straps 15 now pass under the arms of the wearer and are secured to suitable fastener means 20. The portion of the strap extending from the back of the wearer is secured to the garment as with fasteners 21, shown in FIGS. 5 and 6 of the drawings.

The body portion 12 of the garment may be provided with a collar opening 22 permitting for the garment to be slipped over the head of the wearer and thereafter buttoned down as shown in FIG. 6 of the drawings, or the opening may be left open as shown in FIG. 7 of the drawings.

When the straps 15 shown in FIGS. 5 to 7 inclusive are not in use, the same may be fastened interiorly of the garment by means of fasteners 23 secured in any known manner to the interior of the garment.

Obviously, various equivalents and arrangements may be resorted to within the spirit of my invention, and I do not desire to limit myself to the exact construction shown and described, but to avail myself of any modification formed within the scope of the appended claims.

I claim:

1. A garment comprising a main body section adapted to extend over the upper chest and shoulders of the wearer, a fringe area secured along the entire lower edges of said main body section and depending downwardly therefrom, said fringe area comprising a plurality of threads or cords, a pair of strap members detachably secured to the inner surface of said garment, said pair of strap members extending below the arm pits of the wearer thereof and extending to the back portion of the garment and detachably secured thereto, said strap members maintaining the garment in proper position on the upper chest area and the shoulders of the wearer of the garment.

2. The structure recited in claim 1 wherein said straps are secured to the inner side of the garment when the straps are not in use.

3. The structure recited in claim 1 wherein said straps criss-cross at both the front and rear areas of the wearer of the garment when the straps are employed to maintain the garment in position on the shoulder of the wearer.

* * * * *